US011805923B1

(12) United States Patent
Lai et al.

(10) Patent No.: US 11,805,923 B1
(45) Date of Patent: Nov. 7, 2023

(54) STRUCTURE FOR CHILDREN BOUNCE CHAIR

(71) Applicant: TUNG TZU INDUSTRIAL CO., LTD., Tainan (TW)

(72) Inventors: Chin-I Lai, Tainan (TW); Yen-Wen Lai, Tainan (TW); Wei-Jia Lai, Tainan (TW)

(73) Assignee: TUNG TZU INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 17/852,199

(22) Filed: Jun. 28, 2022

(30) Foreign Application Priority Data

Apr. 25, 2022 (TW) ..... 111115558

(51) Int. Cl.
*A47D 13/10* (2006.01)
*A47D 1/00* (2006.01)

(52) U.S. Cl.
CPC ..... *A47D 13/107* (2013.01); *A47D 1/004* (2013.01); *A47D 1/008* (2013.01)

(58) Field of Classification Search
None
See application file for complete search history.

(56) References Cited

U.S. PATENT DOCUMENTS 3,575,404 A * 4/1971 Wesch ..... F16F 1/128 267/74
6,088,937 A * 7/2000 DiClementi ..... E01H 5/06 37/235
8,157,067 B2 * 4/2012 Ruthinowski ..... F16F 1/32 297/472
8,403,308 B2 * 3/2013 Costello ..... F16F 1/128 267/69
10,463,171 B2 * 11/2019 Healy ..... A47D 1/004
2012/0103644 A1 * 5/2012 Walsh ..... A01B 1/026 173/126
2016/0286977 A1 * 10/2016 Thomson ..... A47D 1/0081
2019/0069692 A1 * 3/2019 Healy ..... A47D 13/107
2019/0275982 A1 * 9/2019 Hamilton ..... B60R 21/055

FOREIGN PATENT DOCUMENTS

CA 2390313 A1 * 4/2003 ..... A47D 13/105

* cited by examiner

*Primary Examiner* — David E Allred
(74) *Attorney, Agent, or Firm* — Muncy, Geissler, Olds & Lowe

(57) ABSTRACT

The present invention provides an improved structure for a children bounce chair, comprising a base module, two telescopic support assemblies, a plurality of bounce assemblies and a table and chair module, wherein the telescopic support assemblies are assembled on the base module, one end of the bounce assemblies is respectively assembled on the corresponding telescopic support module, and the other end of the bounce assembly is respectively assembled on the table and chair module, so that the children bounce chair can be easily assembled, used or disassembled and stowed.

5 Claims, 6 Drawing Sheets

STRUCTURE FOR CHILDREN BOUNCE CHAIR

FIELD OF THE INVENTION

The present invention relates to a bounce chair, and more particularly, to an improved structure for a children bounce chair that provides a bounce game when toddlers or children take activities or stand.

BACKGROUND OF THE INVENTION

In today's environment it is common to provide physical or sensory stimulation of activities to the toddlers or children by games, and in particular to induce certain behaviors of the toddlers or children through different toys, whereby the toddlers or children uses the toys to create a corresponding interaction. A bounce chair is one of the commonly used items.

However, the spring of the conventional bounce chair generating the bouncing action is not only exposed but also does not have any protection measures at the spring. Therefore, it is easy to cause harm to the toddlers or children. Meanwhile, when the conventional bounce chair is disassembled and received, since many components cannot be disassembled and stowed, it is inconvenient to stowing and takes up more space. Therefore, it is necessary to provide an improved structure for the bounce chair for the toddlers or children to safely operate and to be easily stowed.

SUMMARY OF THE INVENTION

It is an object of the present invention to provide an improved structure for a children bounce chair that provides bouncing for toddlers or children and stowing.

In order to achieve the above-mentioned objects, the present invention provides an improved structure for a children bounce chair, which comprises a base assembly, two telescopic support assemblies, a plurality of bounce assemblies and a table and chair assembly. The base assembly comprises two connection bases arranged opposite to each other, and two stabilizing rods assembled with the two connection bases, wherein each of the two connection bases includes a first engaging part and two second engaging parts, the first engaging part is provided with a fixing hole, and two ends of each of the two stabilizing rods are respectively assembled with two connection bases via the second engaging parts thereof. The two telescopic support assemblies are respectively arranged on the first engaging part of each of the two connection bases, and each of the two telescopic support assemblies comprises a support rod, an extension rod and a Y-shaped hanger rod, wherein one end of the support rod is provided with a first locator, and an other end of the support rod is provided with a second locator, the first locator of the support rod is engaged with the fixing hole of the first engaging part corresponded, the extension rod is sleeved in the support rod corresponded, and the extension rod is provided with a plurality of locating holes along an axial direction thereof, and wherein the extension rod is provided with the Y-shaped hanger rod at one end that is opposite to an other end of the extension rod assembled with the support rod, and the Y-shaped hanger rod comprises two support arms. Each of the plurality of bounce assemblies comprises a first webbing, a second webbing and a telescopic unit, wherein the first webbing is provided at one end of the telescopic unit, and the second webbing is provided at an other end of the telescopic unit, and the first webbing is located between one of the two support arms and the telescopic unit. The table and chair assembly comprises a seat and a table top assembled on a periphery of the seat, wherein the table top is provided with a plurality of table and chair connector. The second webbing of each of the plurality of bounce assemblies is assembled with one of the plurality of table and chair connectors, and the second webbing is located between one of the plurality of table and chair connectors and the telescopic unit. Each second locator is engaged with one of the plurality of locating holes provided on the extension rod.

Further, the Y-shaped hanger rod further comprises a hanger rod mount, and the two support arms are respectively assembled with two ends of the hanger rod mount.

Further, each of the two stabilizing rods is composed of combination of a plurality of pipe bodies.

Further, the second webbing is provided with a snap-fitting, and the second webbing is assembled with one end of one of the plurality of table and chair connectors by the snap-fitting, the snap-fitting being snap-fitted to the corresponding table and chair connector.

Further, the telescopic unit comprises a housing and an extension spring received in the housing, and the second webbing extends through one end of the housing to be limited at one end of the extension spring.

Further, the first webbing extends through an other end of the housing and is assembled with a fixed post to be limited inside the housing.

Further, the housing is correspondingly provided with two sliding rails in a recessed manner, and the second webbing is provided with a guide post at the end of the extension spring, the guide post is limited by the two sliding rails to move along an axial direction of the housing.

Thus, the present invention has the following beneficial effects over the prior art. After each of the two connection bases is provided with the corresponding stabilizing rod, each of the connection bases is then sequentially provided with the support rod, the extension rod, the Y-shaped hanger rod and the bounce assemblies of the telescopic support assembly, and then the table and chair connectors of the table and chair module are respectively buckled on the corresponding second webbing; and the extension rod is adjusted according to the height required by the child so that the chair and the table top of the table and chair assembly meet the required height. Thus, according to the improved structure for the children bounce chair, the base assembly, the bounce assembly and the table and chair assembly are only required to be sequentially disassembled to reduce the space required for stowing, and the base assembly, the telescopic support assembly, the bounce assembly and the table and chair assembly are sequentially assembled during use, thereby improving the convenience during use. Furthermore, the telescopic units of the bounce assembly comprise the housing for receiving the extension spring, and the housing is provided with the sliding rails for guiding the guide posts assembled with the second webbing to reciprocate in the axial direction of the housing, increasing the safety in use thereof.

DETAILED DESCRIPTION OF THE PREFERRED EMBODIMENTS

Figure 1:
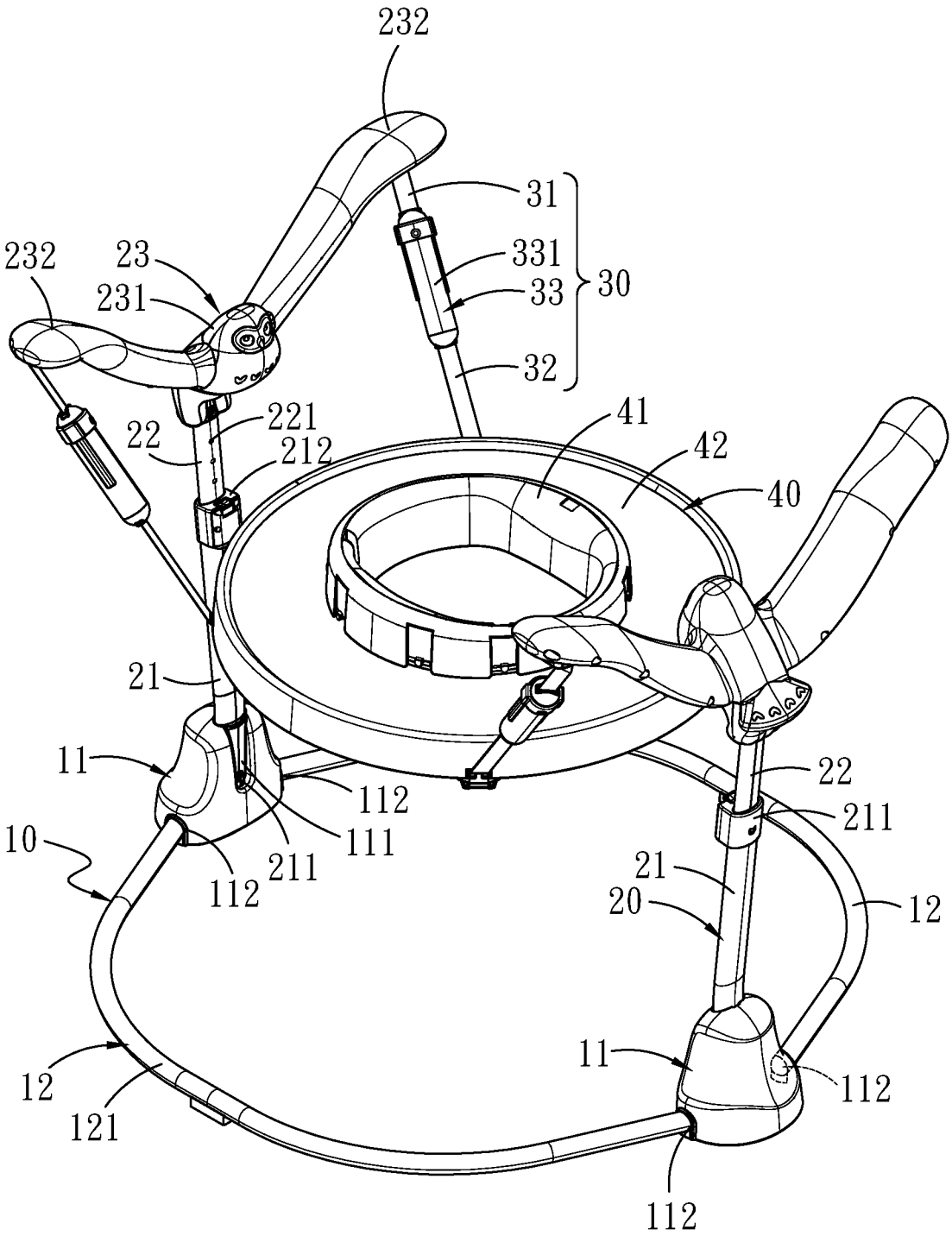
FIG. 1 is a perspective view of an improved structure for a children bounce chair according to the present invention.

Reference are now be made in detail to the preferred embodiments of the technical features and modes of operation of the present application, examples of which are illustrated in the accompanying drawings. Furthermore, the drawings in the present creation are not necessarily drawn to scale, and the scale in the drawings is not intended to limit the scope of the present creation.

With reference to FIG. 1, FIG. 2, FIG. 3, FIG. 4, FIG. 5A and FIG. 5B, the present invention provides an improved structure for a children bounce chair, which mainly comprises a base assembly 10, two telescopic support assemblies 20, a plurality of bounce assemblies 30 and a table and chair assembly 40.

The base assembly 10 includes two connection bases 11 arranged opposite to each other and two stabilizing rods 12 assembled with the two connection bases 11. Each of the two connection bases 11 includes a first engaging part 111 and two second engaging parts 112, wherein the first engaging part 111 is provided with a fixing hole 113, and two ends of each of the two stabilizing rods 12 are respectively assembled with the two connection bases 11 via the second engaging parts 112 thereof, and each of the two stabilizing rods 12 is composed of combination of a plurality of pipe bodies 121.

Each of the two telescopic support assemblies 20 includes a support rod 21, an extension rod 22 and a Y-shaped hanger rod 23. One end of the support rod 21 is provided with a first locator 211, and the other end of the support rod 21 is provided with a second locator 212, wherein the first locator 211 is engaged with the fixing hole 113 of the first engaging part 111 corresponded. The extension rod 22 is sleeved in the support rod 21 corresponded, and the extension rod 22 is provided with a plurality of locating holes 221 along an axial direction thereof; the extension rod 22 is provided with the Y-shaped hanger rod 23 at one end that is opposite to the other end of the extension rod 22 assembled with the support rod 21. The Y-shaped hanger rod 23 includes a hanger rod mount 231 and two support arms 232 respectively assembled with two ends of the hanger rod mount 231 opposite to each other; the Y-shaped hanger rod 23 can be designed in a three-dimensional pattern with an animal shape according to requirements; for example, in one embodiment, the Y-shaped hanger rod 23 is an owl shaped pattern, the hanger rod mount 231 is the head and body of the owl, and the two support arms 232 are wings of the owl, but this is not limited.

Figure 5A:
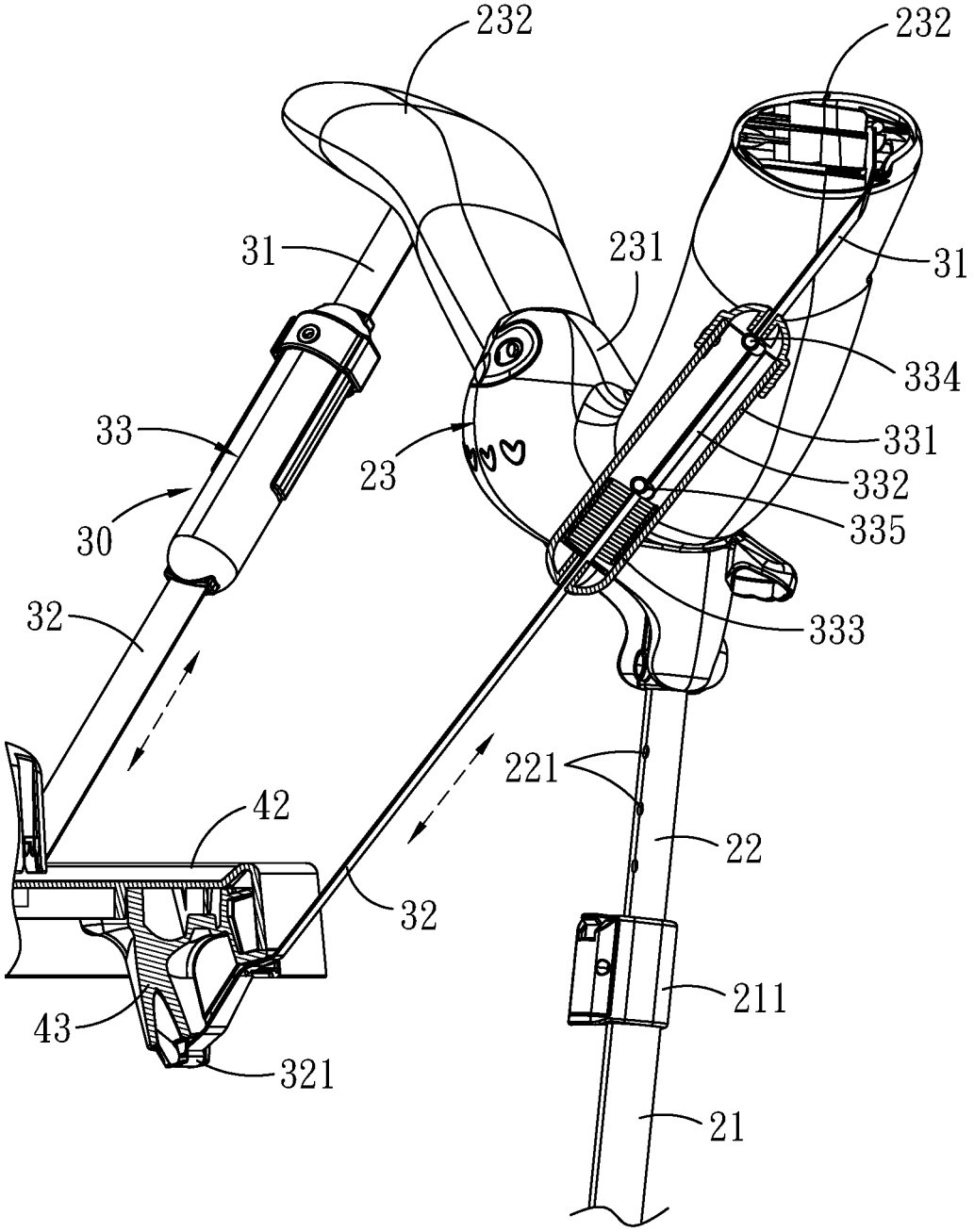
FIG. 5A and FIG. 5B show action diagrams of a bounce module of an improved structure for a children bounce chair according to the present invention.
Figure 5B:
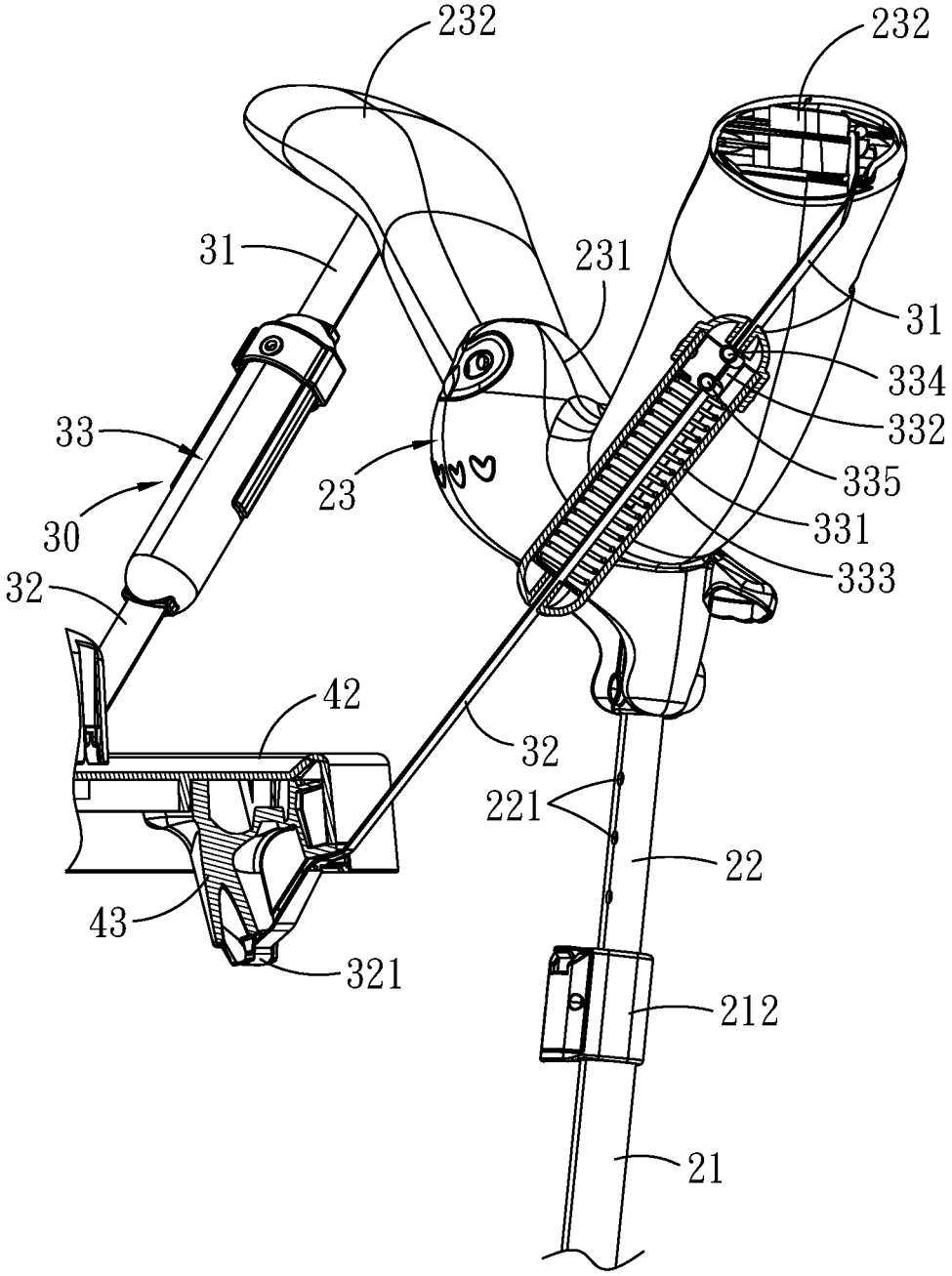

With reference to FIG. 1, FIG. 5A and FIG. 5B, each of the plurality of bounce assemblies 30 includes a first webbing 31, a second webbing 32 and a telescopic unit 33, wherein the first webbing 31 is provided at one end of the telescopic unit 33, and the second webbing 32 is provided at the other end of the telescopic unit 33. The telescopic unit 33 includes a housing 331, two sliding rails 332 correspondingly provided on a side wall of the housing 331 in a recessed manner, and an extension spring 333 accommodated in the housing 331. The first webbing 31 extends through one end of the housing 331 and is assembled with a fixed post 334 to be limited inside the housing 331, and the second webbing 32 extends through the other end of the housing 331 to be limited at one end of the extension spring 333 near the fixed post 334. The second webbing 32 is provided with a guide post 335 at the end of the extension spring 333 near the fixed post 334, wherein the guide post 335 is limited by the two sliding rails 332, and the guide post 335 moves reciprocally along an axial direction of the housing 331 to compress or extend the extension spring 333. Thus, the first webbing 31 is located between one of the two support arms 232 corresponded and the telescopic unit 33. Furthermore, the second webbing 32 is provided with a snap-fitting 321 at one end opposite to the other end assembled with the telescopic unit 33.

The table and chair assembly 40 includes a seat 41 and a table top 42 assembled on the periphery of the seat 41, and the table top 42 is provided with a plurality of table and chair connectors 43.

Figure 2:
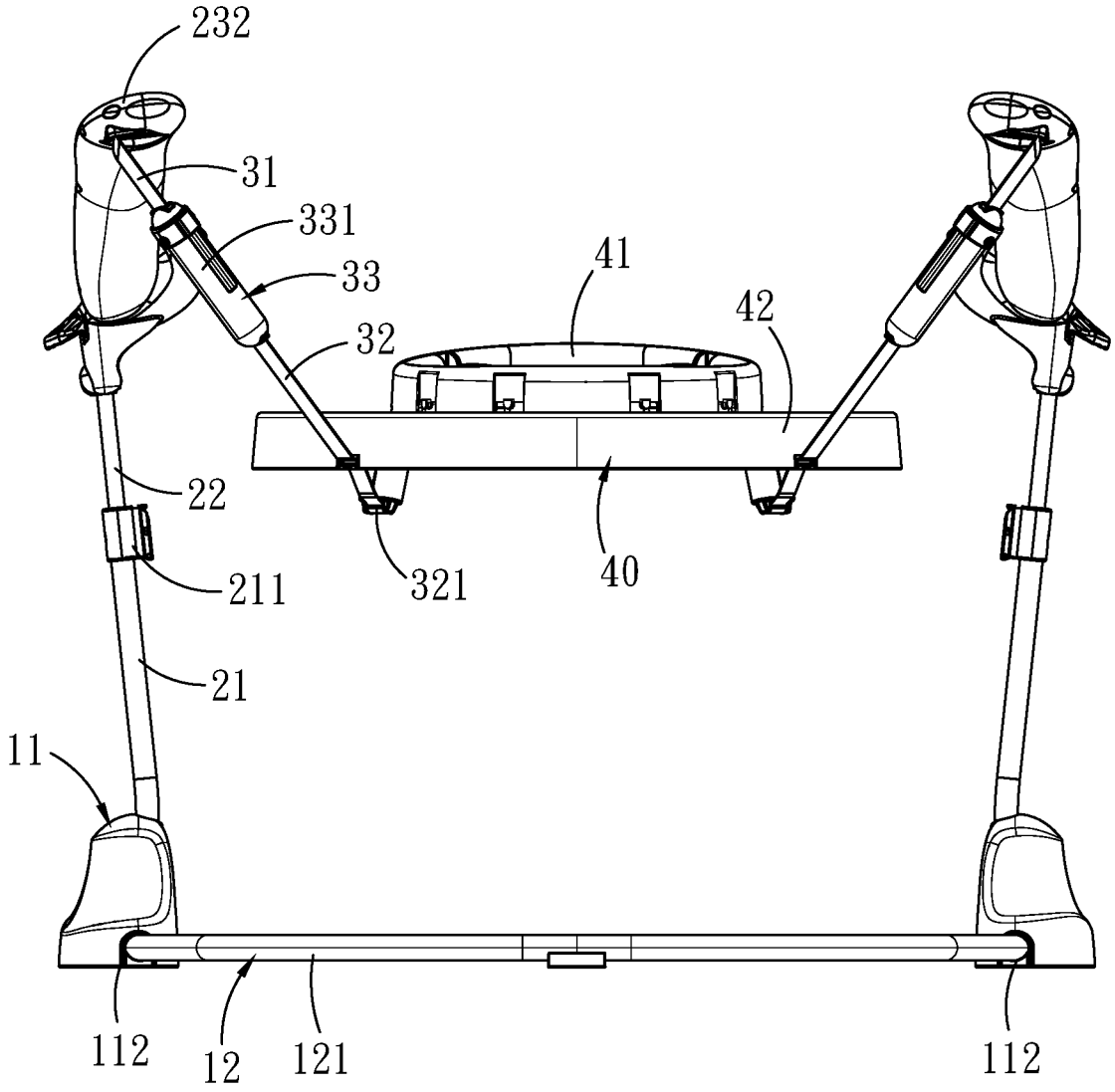
FIG. 2 is a side view of an improved structure for the children bounce chair according to the present invention.
Figure 3:
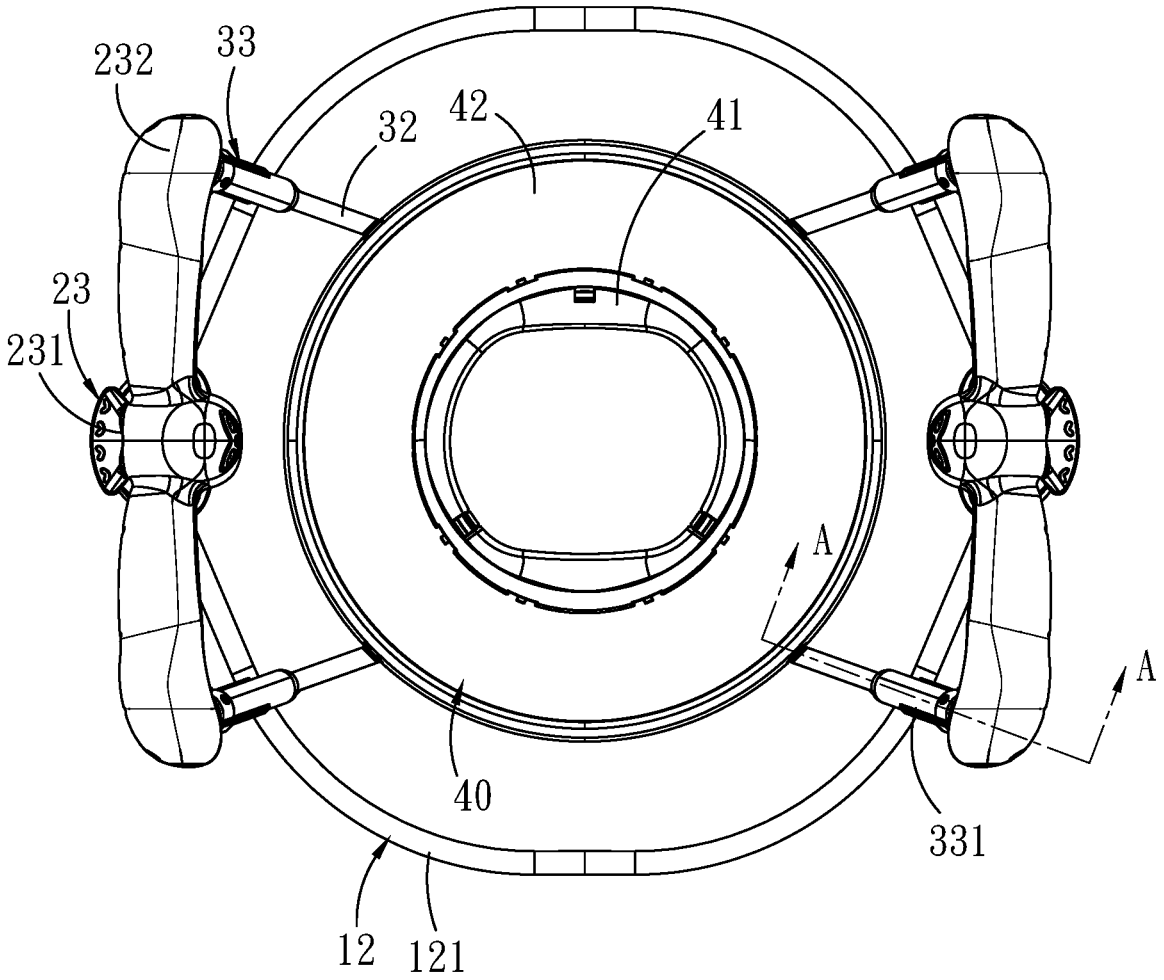
FIG. 3 is a top view of an improved structure for a children bounce chair according to the present invention.
Figure 4:
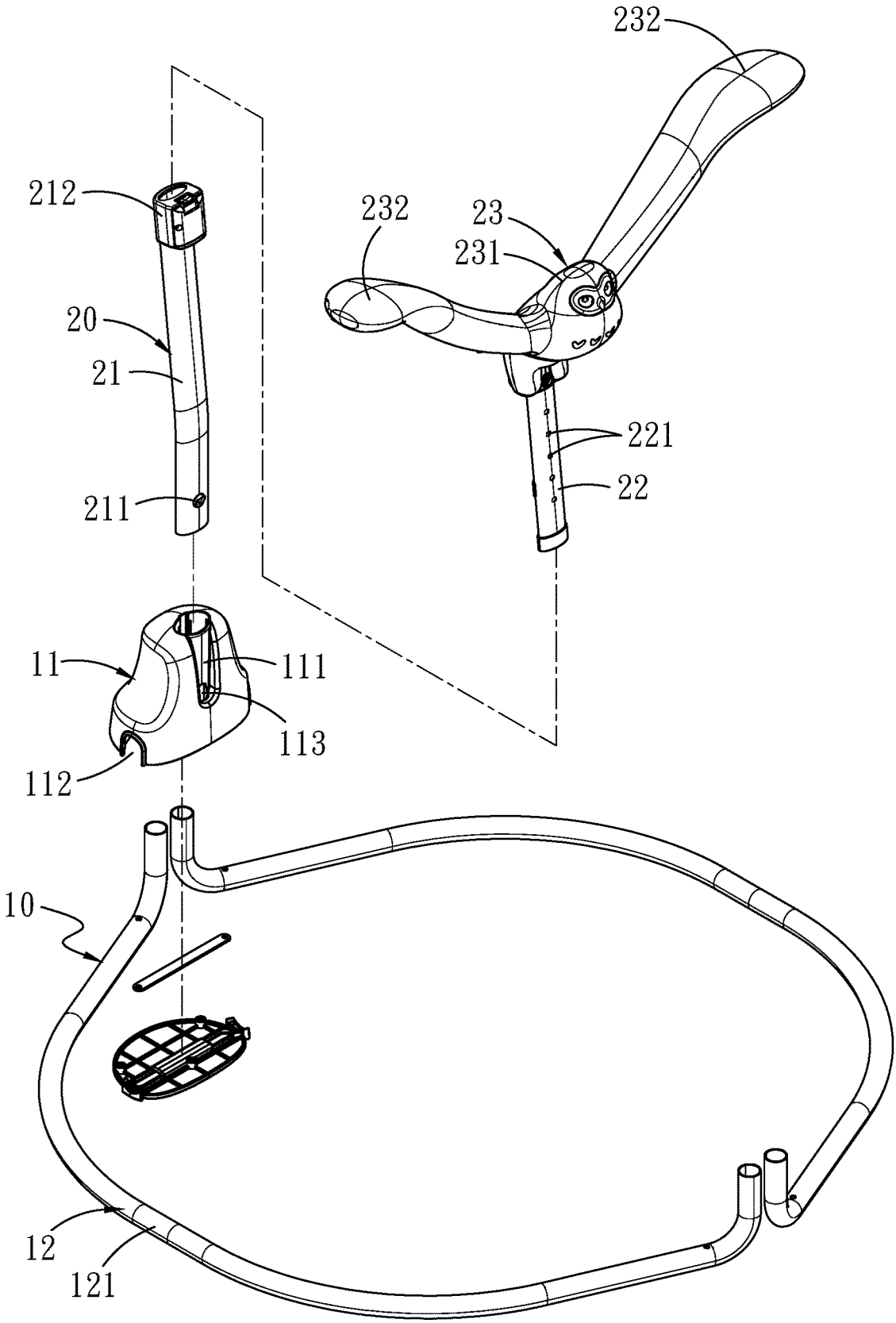
FIG. 4 is a partially exploded schematic view of a bounce module of an improved structure for a children bounce chair according to the present invention.

Herein, with reference to FIG. 2 and FIG. 5B, the second webbing 32 is assembled with one end of one of the plurality of table and chair connectors 43 by the snap-fitting 321, and the second webbing 32 is located between one of the plurality of table and chair connectors 43 corresponded and the telescopic unit 33. In this embodiment, the snap-fitting 321 and the corresponding table and chair connectors 43 are a pair of male and female fastener structures, and the snap-fitting 321 is snap-fitted to the corresponding table and chair connector 43. The second locator 212 is engaged with one of the plurality of locating holes 221 provided on the extension rods 22.

With reference to FIG. 1, FIG. 2, FIG. 3 and FIG. 4, when the improved structure for the children bounce chair is used, the plurality of pipe bodies 121 of the two stabilizing rods 12 of the base assembly 10 are combined, two ends of each of the two stabilizing rods 12 are respectively arranged at one of the two second engaging parts 112 of the two connection bases 11, and two support rods 21 of the two telescopic support assemblies 20 are respectively arranged at two first engaging parts 111; and two first locators 211 of the two support rods 21 are respectively engaged with fixing holes 113 of the two first engaging parts 111. Then, two extension rods 22 are respectively assembled on the two support rods 21, and two second locators 212 are respectively engaged with one of the plurality of locating holes 221 of the two extension rods 22 according to requirements, so that support arms 232 can be suspended by the table and chair assembly 40 assemble with the plurality of bounce assemblies 30. During storage, the base assembly 10, the two telescopic support assemblies 20, the plurality of bounce assemblies 30 and the table and chair assembly 40 can be mostly disassembled or partially disassembled in sequence for storage according to requirements without occupying too much space. Therefore, the improved structure for the children bounce chair has the convenience of assembly and storage.

With reference to FIG. 5A and FIG. 5B, when using the improved structure for the child bouncing chair, children usually adopt a semi-sitting posture in the seat 41 of the table and chair assembly 40. Therefore, when a child is seated on the seat 41, the seat 41 is forced downward so that the plurality of table and chair connectors 43 of the table top 42 pull the second webbings 32. With reference to FIG. 5A, the second webbings 32 pull the guide posts 335 in the sliding rails 332 to compress the extension springs 333 along the axial directions of the housings 331, respectively, so that the guide posts 335 of the two extension springs 333 move in an direction towards the table and chair assembly 40 along the sliding rails 332. With reference to FIG. 5B, after the extension springs 333 are compressed by the guide posts 335, respectively, each of the extension springs 333 generates an elastic return restoring force, so that the extension springs 333 move in a direction toward the two support arms 232 again. Therefore, the extension springs 333 pull the second webbing 32, respectively, so that the table and chair assembly 40 will generally generate an up and down bouncing posture. The extension springs 333 are received in the housings 331 to prevent the children's fingers from being clamped by two extension springs 333, thereby increasing a safety in use.

In view of the above, according to the improved structure for the children bounce chair of the present invention, the base assembly 10 is provided with the two stabilizing rod 12 by the two connection bases 11, and then is sequentially provided with the two support rods 21, the two extension rods 22, the two Y-shaped hanger rods 23 and the plurality of bounce assemblies 30 of the two telescopic support assemblies 20. The plurality of table and chair connectors 43 of the table and chair assembly 40 are respectively fastened to one of the second webbings 32 corresponded, and the two extension rods 22 are adjusted according to a height required by the child, so that the seat 41 and the table top 42 of the table and chair assembly 40 meet the height required, whereby the improved structure for the children bounce chair only needs to sequentially disassemble the base assembly 10, the two telescopic support assemblies 20, the plurality of bounce assemblies 30 and the table and chair assembly 40 to reduce storage space required, and then sequentially assemble the base assembly 10, the two telescopic support assemblies 20, the plurality of bounce assemblies 30 and the table and chair assembly 40 when in use, so that the convenience of use can be improved. Furthermore, the telescopic unit 33 of each of the plurality of bounce assemblies 30 is provided with the housing 331 for accommodating the extension spring 333, and the housing 331 is provided with the two sliding rails 332 for guiding the guide posts 335 assembled by the second webbing 32 to reciprocate in the axial direction of the housing 331, increasing the safety in use thereof

What is claimed is:

1. An improved structure for a children bounce chair, comprising:

a base assembly, comprising two connection bases arranged opposite to each other, and two stabilizing rods assembled with the two connection bases, wherein each of the two connection bases includes a first engaging part and two second engaging parts, the first engaging part is provided with a fixing hole, and two ends of each of the two stabilizing rods are respectively assembled with the two connection bases via the second engaging parts thereof;

two telescopic support assemblies, respectively arranged on the first engaging part of each of the two connection bases, and each of the two telescopic support assemblies comprising a support rod, an extension rod and a Y-shaped hanger rod, wherein one end of the support rod is provided with a first locator, and an other end of the support rod is provided with a second locator, the first locator of the support rod is engaged with the fixing hole of the first engaging part, the extension rod is sleeved in the support rod, and the extension rod is provided with a plurality of locating holes along an axial direction thereof, and wherein the extension rod is provided with the Y-shaped hanger rod at one end that is opposite to an other end of the extension rod assembled with the support rod, and the Y-shaped hanger rod comprises two support arms;

a plurality of bounce assemblies, each of the plurality of bounce assemblies comprising a first webbing, a second webbing and a telescopic unit, wherein the first webbing is provided at one end of the telescopic unit, and the second webbing is provided at an other end of the telescopic unit, and the first webbing is located between one of the two support arms and the telescopic unit; and a table and chair assembly, comprising a seat and a table top assembled on a periphery of the seat, wherein the table top is provided with a plurality of table and chair connectors;

wherein the second webbing of each of the plurality of bounce assemblies is assembled with one of the plurality of table and chair connectors, and the second webbing is located between one of the plurality of table and chair connectors and the telescopic unit; and wherein each second locator is engaged with one of the plurality of locating holes provided on the extension rod; the telescopic unit comprises a housing and an extension spring received in the housing, and the second webbing extends through one end of the housing to be limited at one end of the extension spring; and wherein the housing is correspondingly provided with two sliding rails in a recessed manner, and the second webbing is provided with a guide post at the end of the extension spring, the guide post is limited by the two sliding rails to move along an axial direction of the housing.

2. The improved structure for the children bounce chair according to claim 1, wherein the Y-shaped hanger rod further comprises a hanger rod mount, and the two support arms are respectively assembled with two ends of the hanger rod mount.

3. The improved structure for the children bounce chair according to claim 1, wherein each of the two stabilizing rods is composed of a combination of a plurality of pipe bodies.

4. The improved structure for the children bounce chair according to claim 1, wherein the second webbing is provided with a snap-fitting, and the second webbing is assembled with one end of one of the plurality of table and chair connectors by the snap-fitting, the snap-fitting being snap-fitted to the corresponding table and chair connector.

5. The improved structure for the children bounce chair according to claim 1, wherein the first webbing extends through an other end of the housing and is assembled with a fixed post to be limited inside the housing.

* * * * *